US005562128A

United States Patent [19]

Haeussler et al.

[11] Patent Number: 5,562,128

[45] Date of Patent: Oct. 8, 1996

[54] ADJUSTABLE WARP TENSION ROLL SUPPORT IN A WEAVING LOOM

[75] Inventors: Horst Haeussler, Lindau; Wilhelm Herrlein, Neuravensburg, both of Germany

[73] Assignee: Lindauer Dornier Gesellschaft mbH, Lindau, Germany

[21] Appl. No.: 506,217

[22] Filed: Jul. 24, 1995

[30] Foreign Application Priority Data

Jul. 30, 1994 [DE] Germany ..... 44 27 129.8

[51] Int. Cl.[6] ..... D03D 49/12

[52] U.S. Cl. ..... 139/115

[58] Field of Search ..... 139/114, 115

[56] References Cited

U.S. PATENT DOCUMENTS

| | | | |
|---|---|---|---|
| 2,755,822 | 7/1956 | Hunt | 139/114 X |
| 2,951,509 | 9/1960 | Pfarrwaller | 139/114 |
| 4,193,428 | 3/1980 | Demuth | 139/114 |
| 4,256,147 | 3/1981 | DeGorde | 139/115 |

FOREIGN PATENT DOCUMENTS

| | | |
|---|---|---|
| 0109472 | 5/1984 | European Pat. Off. . |
| 0409306 | 1/1991 | European Pat. Off. . |

*Primary Examiner*—Andy Falik
*Attorney, Agent, or Firm*—W. G. Fasse; W. F. Fasse

[57] ABSTRACT

The warp threads (30) in a weaving loom are guided by a warp guide roller (16) and tightened by a warp tension roller (21). Both rollers (16, 21) are rotatably supported on a plurality of carrier brackets (15) spaced from each other along the loom weaving width and secured to a crossbar (2) operatively mounted in the loom frame by mountings (4, 6, 7). Each carrier bracket (15) has at its free end a bearing (15A) in which the warp guide roller (16) rotatably rests. Each carrier bracket (15) further carries at least one warp tensioning lever (19) journalled to the respective bracket (15) and having a bearing (19A) for supporting the warp tensioning roller (21). A cam drive (28, 29) biased by a spring (12) operates the warp tensioning levers (19) and thus the warp tensioning roller (21) into a warp tensioning position.

17 Claims, 3 Drawing Sheets

ADJUSTABLE WARP TENSION ROLL SUPPORT IN A WEAVING LOOM

CROSS-REFERENCE TO RELATED APPLICATION

The present application is related to our copending, commonly assigned application U.S. Ser. No.: 08/506,219, filed on Jul. 24,1995 The disclosure of the related application is incorporated herein by reference.

FIELD OF THE INVENTION

The invention relates to a weaving loom wherein warp thread handling loom components are mounted in first and second laterally outer loom frame members including mounting members. A crossbar reaches across the entire loom width and carries for example a warp tensioning roller, a warp guide roller, and a drive. Biasing elements are provided for tensioning the warp threads referred to herein as the warp.

BACKGROUND INFORMATION

European Patent Publication EP 0,109,472 A1 (Pfarrwaller) published Mar. 30, 1984 discloses an apparatus for tensioning the warp threads in a loom. The purpose of such tensioning apparatus is to present the warp with a substantial warp tension to the shed forming elements of the loom. The warp tension must remain at a certain level during the entire withdrawal of the warp from the warp beam. Further, the inertia of the tensioning elements must be as small as possible to assure that periodic oscillations of the warp tensioning element are performed with the required rapidity. The above European Patent Publication 0,109,472 discloses a tensioning rod biased by a spring and supported by a support beam on which the tensioning rod is supported by several supports distributed along the weaving width. Additionally, the support beam and the tensioning rod are tiltably mounted for tilting about the longitudinal axis of the support beam. The tensioning rod itself is of rigid construction and is not supposed to have an inherent spring characteristic. If the support beam itself is tiltably mounted in the loom frame, the tensioning rod may be rigidly secured to the support beam. The support beam of the tensioning rod and a warp guide beam are mounted in a plurality of bearing plates positioned below the weaving plane and supported in the loom frame so that the support beam and the warp guide beam are positioned between the warp beam and the tensioning rod.

The just described conventional mounting of the support beam, of the tensioning rod, and of the warp guide beam makes it possible that these elements can be constructed with relatively small cross sectional dimensions so that these elements have a relatively small mass. However it is a disadvantage that the tensioning rod must necessarily be rigidly connected to the support beam by respective connecting elements. Such a construction is not cost efficient in view of the manufacturing steps needed for the rigid connecting elements between the support beam and the tensioning rod.

Another conventional warp tensioning device is disclosed in European Patent Publication EP 0,409,306 A1 (Vandeweghe et al.) published Jul. 17, 1989, wherein the tensioning device is constructed for periodically influencing the warp tension in response to the warp tension that occurs during the beat up and corresponding shed change. For this purpose the backrest in the tensioning device of European Patent Publication EP 0,409,306 A1 is mounted in the loom frame on two supports which in turn are mounted on respective carrier arms positioned below and parallel to the weaving plane. Each carrier arm is in turn articulated with one end to a second arm which is tiltably mounted. The other end of the carrier arm is operatively connected with a camshaft driven by a gear drive. The cam stroke makes it possible to periodically tension and to slacken the warp. The just described tensioning device leaves room for improvement, especially with regard to reducing the mass of the entire warp tensioning unit including the warp tensioning roller and the warp guide roller.

OBJECTS OF THE INVENTION

In view of the above it is the aim of the invention to achieve the following objects singly or in combination:

- to construct a warp tensioning device so that the mass of the device is optimally small while still assuring the required warp tension uniformly across the weaving width;
- to avoid the conventional use of a support beam on which a warp tensioning roller is rigidly mounted;
- to reduce particularly the mass of the warp tensioning roller and of the warp guide roller by mounting these last named rollers loosely in the loom frame; and
- to permit an easy exchange of one set of warp handling rollers having a given diameter for another set of such rollers having another diameter whereby each set includes at least a warp tensioning and a warp guide roller.

SUMMARY OF THE INVENTION

The above objects have been achieved in an apparatus for tensioning the warp in a weaving loom which is characterized by the following features. A crossbar is rigidly mounted in the loom frame but can be loosened for an angular adjustment. The crossbar supports at least two carrier brackets preferably a plurality of carrier brackets spaced from each other along the crossbar extending across the weaving width. Each carrier bracket has a mounted end and a free support end providing a bearing for rotatably supporting or holding a warp guide roller. Further, each carrier bracket carries at least one warp tensioning lever that is tiltably journalled to the respective carrier bracket. Each warp tensioning lever comprises a bearing for rotatable carrying a warp tensioning roller. A cam drive preferably also supported by the carrier brackets is operatively connected to the warp tensioning levers for operating the warp tensioning levers to thereby tension the warp by respectively moving the warp tensioning roller. A biasing mechanism is cooperating with the cam drive for maintaining the cam drive and the respective warp tensioning lever in operating contact with each other and to maintain a certain warp tension over a weaving cycle.

The cam drive comprises for example cam disks each with a cam member and all the cam disks are supported on a shaft which in turn is rotatable mounted in bearings axially aligned in the carrier brackets.

Each warp tensioning lever is preferably a single arm lever one end of which is journalled to the respective carrier bracket while the other end carries the bearing such as a sleeve or rather slide bearing or bearing rollers for the warp tensioning roller. The tensioning cam drive cooperates with the one armed lever at a point intermediate between the respective journal and the bearing rollers for the warp tensioning roller. However, it is also possible to construct the warp tensioning lever as a two armed lever that is journalled intermediate its ends whereby one end carries the bearing or bearing rollers for the warp tensioning roller while the other end of the warp tensioning lever carries a cam follower roller cooperating with the cam drive.

The advantages according to the invention are seen in that the cooperation of elements for a tension of the warp can be accomplished by relatively lightweight components, especially moving components, of the entire tensioning device. Further, any relative motions between the warp and the warp tensioning roller on the one hand and any relative motions between the warp and the warp guide roller have been avoided according to the invention thereby preventing damage to the warp threads. Yet another advantage is seen in that a set including a warp guide roller and a warp tensioning roller having a given diameter can be easily exchanged against a respective set including a warp tensioning roller and a warp guide roller having different diameters. Such exchange is possible because the support bearings for the warp guide roller and the support bearings for the warp tensioning roller are constructed as saddle bearings in which the respective roller floats and is held in place by gravity.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
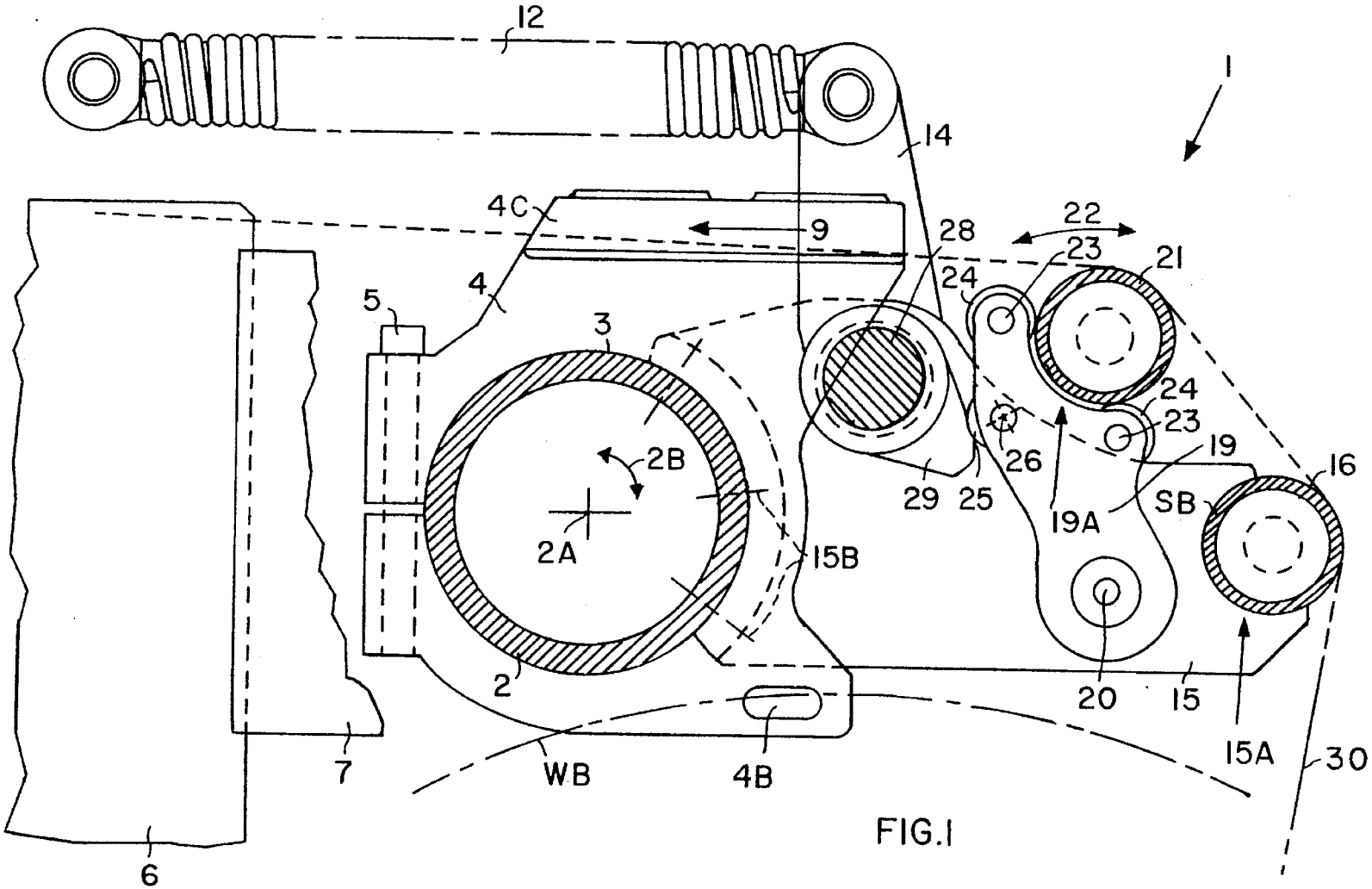
FIG. 1 is an axial view, partly in section, of a first embodiment of the warp tensioning device according to the invention with a warp guide roller rotatable held in a slide saddle bearing.
Figures 2, 2A:
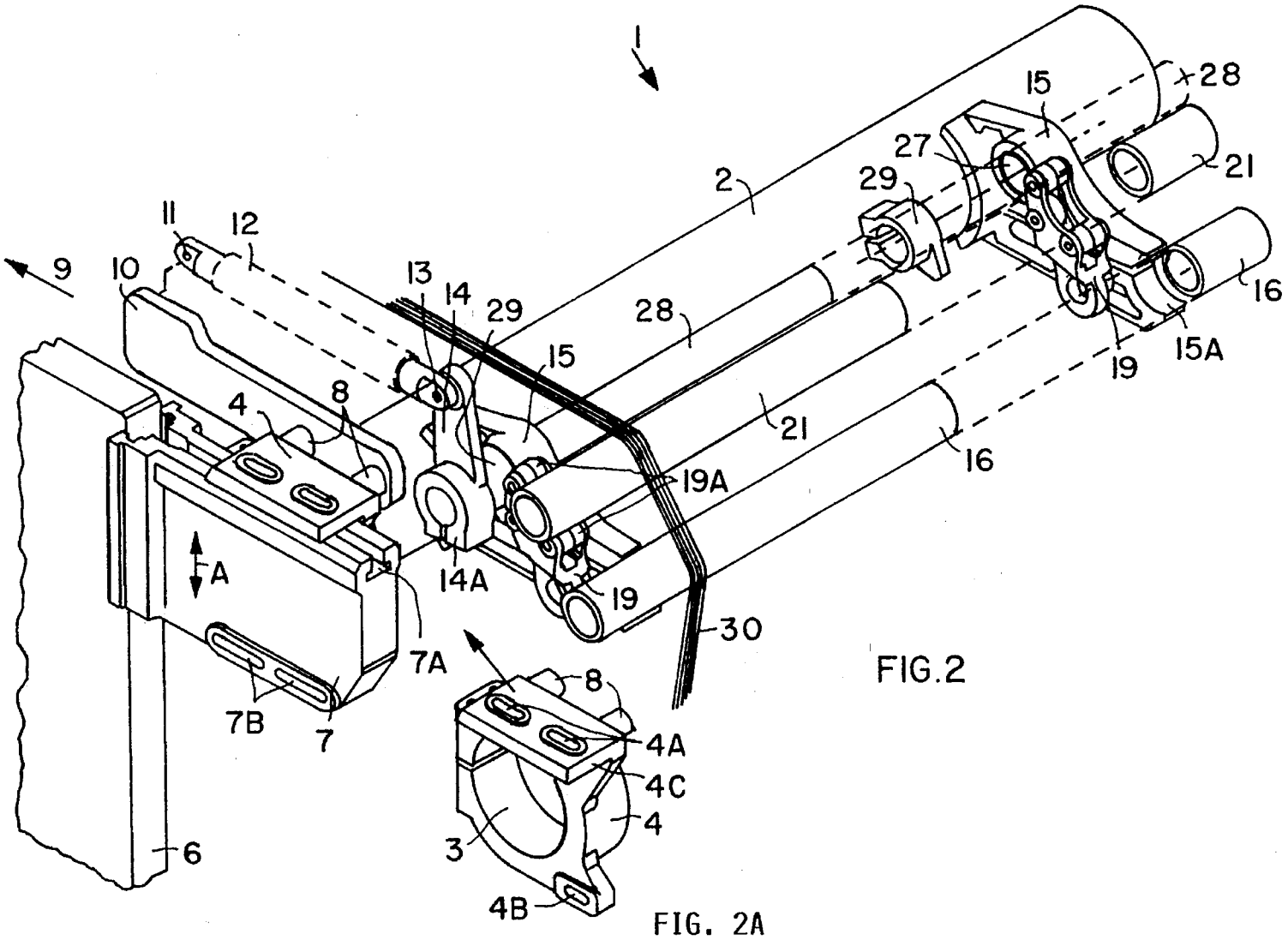
FIG. 2 is a perspective view of the mechanism shown in FIG. 1.
FIG. 2A shows a mounting member for a crossbar of the present warp tensioning device.

FIG. 1 shows a warp tensioning mechanism 1, comprising a cross bar 2 having a longitudinal central axis 2A, supported at each end in a bearing opening 3 of a mounting member 4 constructed as a clamp that includes a slide section 4C with elongated holes 4A and 4B as best seen in FIG. 2A. The clamp 4 can be tightened by a threaded bolt 5, for rigidly holding the cross bar 2 in place. However, by loosening the bolt 5, the cross bar 2 can be angularly adjusted about its longitudinal axis 2A as indicated by the arrow 2B. Once the angular adjustment is completed, the bolt 5 is tightened again.

It should be mentioned here, that the Figs. show the left hand mounting of the present mechanism as seen by a viewer facing in the warp moving direction indicated by arrow 9. The mounting members at the right hand side of the loom are mirror symmetrical to the mounting members shown in the drawing for the left hand side of the loom.

Referring to FIG. 2, the loom frame has upright frame members 6, at least one on each side. A horizontal mounting arm 7 is releasably but rigidly mounted to one upright frame member 6, on each loom side. When the arm 7 is released it can be vertically adjusted as indicated by the arrow A. The top edge of the mounting arm 7 forming a first mounting member has a guide track 7A, in which the slide section 4C of the mounting member 4 is slidably received for a horizontal back and forth adjustment. Once the mounting member 4 which forms with its sliding section 4C a second mounting member, has been adjusted horizontally, it is tightened to the mounting arm 7 by bolts, not shown, but passing through the elongated hole 4B shown in FIG. 2A and through the elongated holes 7B in the mounting arm 7. Further clamping bolts, not shown, however constructed to engage the guide rail 7A and to pass through the elongated holes 4A of the second mounting member 4 also secure the first and second mounting members 7 and 4 to each other.

Referring further to FIG. 2, the second mounting member 4 is provided with two studs 8, for example. A support arm 10 for a biasing, helical spring 12 is mounted to the studs 8 . The support arm 10 extends in the direction of the arrow 9, namely in the fabric advance direction. One end 11 of the biasing spring 12 is pivoted to the free end of the arm 10. The helical spring 12 is preferably a tension spring. The other end 13 of the biasing spring 12 is pivoted to a lever arm 14 having a mounted end 14A rigidly secured to a drive shaft 28 of a cam disk 29 to be described in more detail below.

According to the invention, at least two, preferably more than two, carrier brackets 15 are secured to the crossbar 2 by screws 15B. If only two carrier brackets 15 are used, they are positioned along the weaving width so as to optimally reduce any tendency of a warp guide roller 16 and a warp tensioning roller 21 to bend. The screws 15B are shown symbolically at 15B in FIGS. 1 and 3. For this purpose, the mounted end of each carrier bracket 15 is provided with a curved flange as best seen in FIG. 2. All carrier brackets 15 are aligned in a common plane so that the respective support bearings are also aligned.

Each of the carrier brackets 15 comprises at its free end opposite its mounted end a bearing 15A which is shown as a slide bearing SB in FIG. 1 and as an antifriction bearing AB with rollers 17 journalled at 18 to the free end of the respective carrier bracket 15. In both instances, these bearings 15A form a saddle in which the warp guide roller 16 is floatingly held by gravity and by the warp tension. Especially the bearings AB with rollers 17 make it easy to replace the warp guide roller 16 of one diameter by another warp guide roller having a different diameter.

Figure 3:
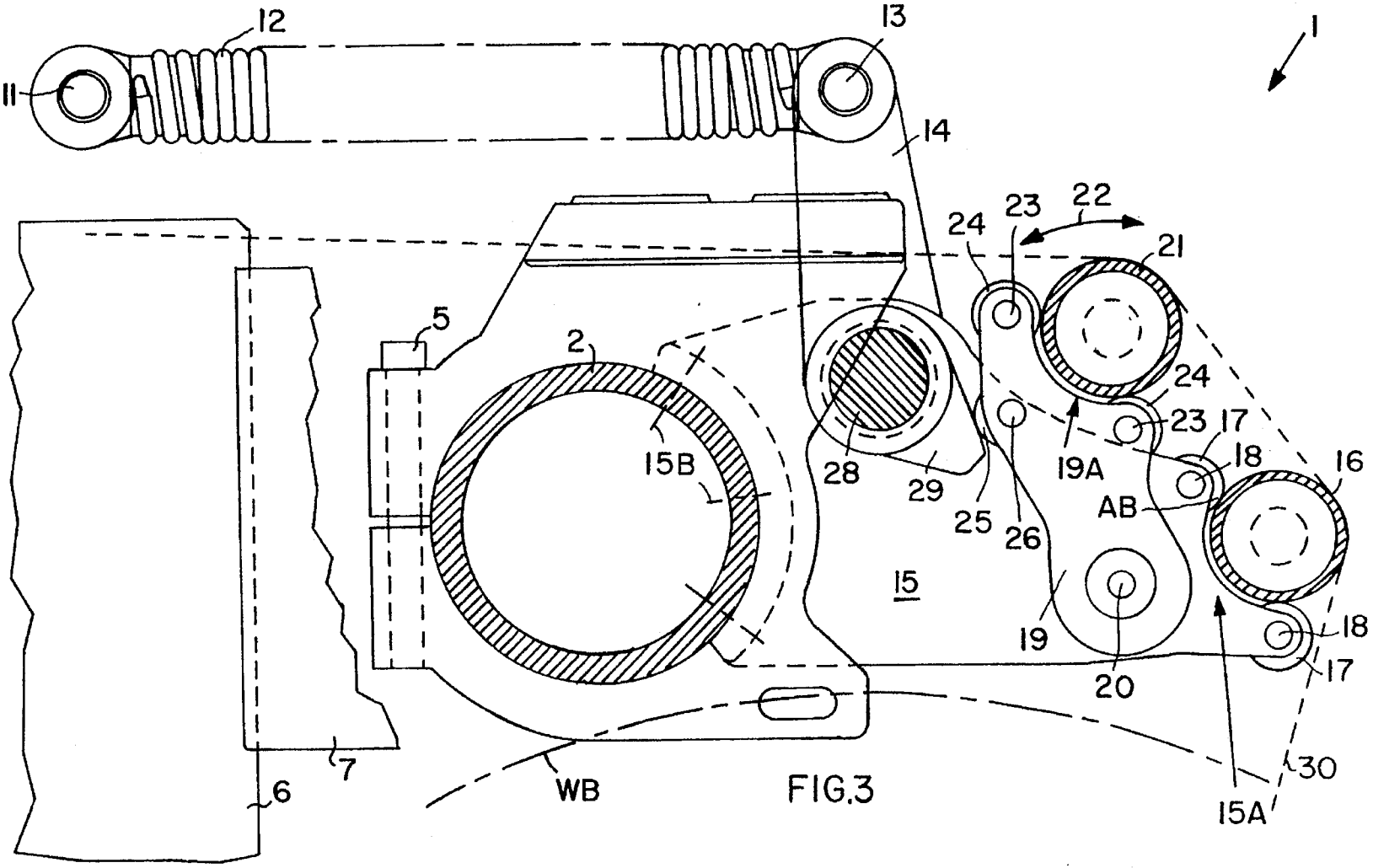
FIG. 3 is a view similar to that of FIG. 1, however illustrating a saddle bearing with bearing rollers for the warp guide roller.

The above mentioned warp tensioning roller 21 is supported in bearings 19A that are similar to the bearings 15A. The bearings 19A may also be formed as slide bearings or they may be formed by rollers 24 journalled at 23 to a respective one arm warp tensioning lever 19 which in turn is journalled at 20 to the respective carrier bracket 15. Each carrier bracket 15 carries at least one warp tensioning lever 19 that is tiltable about its journal axis 20, as shown in FIGS. 1 and 3. The journal 20 is preferable as short as possible, so that the respective warp tensioning lever 19 is mounted close to its carrier bracket 15 or even in its carrier bracket 15.

In a modified embodiment the warp tensioning lever 19 is a two-armed lever that is journalled intermediate its arms, whereby one arm is provided with the bearings 19A and the other arm cooperates with a cam drive including a cam drive shaft 28 and a cam drive member 29 or directly with the biasing spring 12. In both instances of the construction of the warp tensioning lever 19, the cam drive member 29 driven by the cam drive shaft 28 will operate the warp tensioning lever 19 to oscillate back and forth as indicated by the double arrow 22 to tighten or decrease the tension of the warp 30. A certain tension of the warp 30 is established by the tension spring 12. A necessary warp tension is maintained by a warp let-off connected to a warp beam WB shown symbolically by a dashed line in FIGS. 1 and 3.

The above mentioned cam drive shaft 28 that is rotatably mounted in the loom frame by the carrier brackets 15 cam. Preferably, the drive shaft 28 is mounted in bearings 27 that are formed in the carrier brackets 15. The bearings 27 of all brackets 15 are horizontally aligned with each other to receive the drive shaft 28 in a rotatable manner. The lever 14 forming a crank is rigidly connected with its mounted end 14A shown in FIG. 2 to one end of the drive shaft 28 and with its other end to the biasing spring 12 which keeps the cam member 29 in operative engagement with the warp tensioning lever 19, preferably through a cam follower roller 25 journalled to the lever 19 at 26. The cam member 29 is rigidly connected to the drive shaft 28.

The journals 23 and the journal 26 on the warp tensioning lever 19 are positioned at the corner of a triangle in such a way that the angle formed between triangle sides and having its tip in the journal 26 is an obtuse angle.

In operation, the spring 12 keeps the cam member or members 29 in engagement with the cam follower roller 25 thereby providing the necessary warp tension. When the shaft 28 responds to the warp let-off caused by the respective warp beam motion, the necessary warp tension is maintained as the warp tensioning lever 19 moves to the right in FIGS. 1 and 3.

Although the invention has been described with reference to specific example embodiments, it will be appreciated that it is intended to cover all modifications and equivalents within the scope of the appended claims.

What is claimed is:

1. An apparatus for tensioning the warp in a weaving loom having a weaving width, comprising a warp tensioning roller (21), a warp guide roller (16), a loom frame including two upright loom frame members (6), a crossbar (2) extending across said weaving width of said weaving loom, mounting members (4, 7) securing ends of said crossbar (2) to the respective frame members (6), a plurality of carrier brackets (15) for carrying said warp guide roller (16), each of said carrier brackets (15) having a first free support end (15A) for rotatably supporting said warp guide roller (16) and a second mounted end operatively secured to said crossbar (2), said carrier brackets (15) being spaced from each other along said crossbar (2), at least one warp tensioning lever (19) and a journal (20) tiltably securing said warp tensioning lever (19) to its respective carrier bracket (15) of said plurality of carrier brackets (15), said warp tensioning lever (19) comprising a bearing (19A) for rotatably carrying said warp tensioning roller (21), a cam drive (28,29) including a cam drive shaft (28) rotatably mounted in said carrier brackets (15), and at least one cam drive member (29) rigidly secured to said cam drive shaft (28) in a position for operative engagement with said at least one warp tensioning lever (19), and a biasing mechanism (12,14) including a biasing arm (14) and a biasing spring (12), said biasing arm being rigidly secured to said cam drive shaft (28) and to said biasing spring (12) for elastically biasing said warp tensioning roller (21) by said biasing spring (12) through said cam drive (28,29).

2. The apparatus of claim 1, wherein said cam drive (28, 29) comprises a drive shaft (28) rotatably mounted in said loom frame and a cam member (29) rigidly mounted on said drive shaft (28) for cooperation with said warp tensioning lever (19).

3. The apparatus of claim 2, wherein each of said carrier brackets (15) comprises a bearing (27) arranged so that all bearings (27) are axially aligned with each other across said weaving width of said loom, said drive shaft (28) being rotatably mounted in said bearings (27) and thus in said carrier brackets (15).

4. The apparatus of claim 3, wherein said biasing mechanism comprises a helical spring (12) and a lever arm (14) having a first lever end (13) pivoted to one end of said helical spring (12) and a second lever end (14A) rigidly connected to said drive shaft (28), said helical spring (12) having another end secured to said loom frame.

5. The apparatus of claim 1, wherein said first free support end of said carrier brackets (15) comprises a saddle bearing (15A) for rotatably supporting said warp guide roller (16).

6. The apparatus of claim 5, wherein said saddle bearing is a slide bearing for said warp guide roller (16).

7. The apparatus of claim 5, wherein said saddle bearing comprises a plurality of rotatable rollers for supporting said warp guide roller (16).

8. The apparatus of claim 1, wherein said bearing of said warp tensioning lever (19) comprises a saddle bearing (19A) for rotatably supporting said warp tensioning roller (21).

9. The apparatus of claim 8, wherein said saddle bearing is a slide bearing in said warp tensioning lever (19) for supporting said warp tensioning roller (21).

10. The apparatus of claim 8, wherein said saddle bearing comprises a plurality of support rollers (24) journalled on said warp tensioning lever (19) for supporting said warp tensioning roller (21).

11. The apparatus of claim 1, further comprising a cam follower roller (25) journalled to said warp tensioning lever (19) and wherein said cam drive comprises a cam member (29) arranged for engaging said cam follower roller (25) under a biasing force exerted by said biasing mechanism, so that said biasing mechanism keeps said cam member (29) engaged with said cam follower roller (25).

12. The apparatus of claim 1, further comprising two support rollers (24) journalled to said warp tensioning lever (19) at first and second positions (23) for forming a saddle bearing for said warp tensioning roller (21) and a cam follower roller (24) journalled to said warp tensioning lever (19) at a third position (26) defining a triangle with said first and second positions, said third position forming the tip of an obtuse angle between two sides of said triangle.

13. The apparatus of claim 1, wherein said mounting members comprise two first mounting members (7) operatively secured to a respective one of said upright loom frame members (6), two second mounting members (4) secured to the respective first mounting member (7), each second mounting member (4) comprising a clamp seat (3) in which an end of said cross bar (2) is releasably mounted for an angular adjustment of said crossbar (2) about its longitudinal crossbar axis (2A), said clamp seat (3) comprising a clamping bolt (5) for rigidly locking said crossbar (2) in an adjusted position.

14. The apparatus in claim 1, wherein said crossbar (2) has a longitudinal axis (2A) and a rotational symmetry about said longitudinal axis (2A).

15. The apparatus of claim 1, wherein said warp tensioning lever (19) is a one arm lever.

16. The apparatus of claim 1, wherein said warp tensioning lever is a rocker lever with two arms.

17. The apparatus of claim 1, wherein each of said crossbar (2), said warp guide roller (16), and said warp tensioning roller (21) is a hollow tubular member.

* * * * *

UNITED STATES PATENT AND TRADEMARK OFFICE

CERTIFICATE OF CORRECTION

PATENT NO. : 5,562,128

DATED : October 8, 1996

INVENTOR(S) : Haeussler et al.

It is certified that error appears in the above-identified patent and that said Letters Patent is hereby corrected as shown below:

Title page:

In [54] the Title should read:

--ADJUSTABLE WARP TENSION ROLL SUPPORT--.

In [56] under "U.S. PATENT DOCUMENTS" for "4,256,147 3/1981" the name should be --Deborde--;

In [56] under "FOREIGN PATENT DOCUMENTS" the reference --No.: 0,231,726 8/1987 European Pat. Off.-- should be added.

Column 1, lines 1 and 2, the title should read:

--ADJUSTABLE WARP TENSION ROLL SUPPORT--.

Signed and Sealed this

Seventeenth Day of December, 1996

*Attest:*

*Attesting Officer*

Bruce Lehman

BRUCE LEHMAN

*Commissioner of Patents and Trademarks*